United States Patent [19]

Timm

[11] Patent Number: 5,020,172

[45] Date of Patent: Jun. 4, 1991

[54] FOLDABLE SIDE RAIL MEMBER

[75] Inventor: Robert Timm, Park Forest, Ill.

[73] Assignee: Dresher, Incorporated, Bedford, Ill.

[21] Appl. No.: 447,607

[22] Filed: Dec. 8, 1989

[51] Int. Cl.[5] ..... A47C 19/00

[52] U.S. Cl. ..... 5/200.1; 5/202; 403/102

[58] Field of Search ..... 5/149, 174, 175, 177, 5/181, 184, 185, 200 R, 200 C, 202, 249, 250, 282.2, 286; 403/53, 62, 100, 102

[56] References Cited

U.S. PATENT DOCUMENTS

| | | | |
|---|---|---|---|
| 729,692 | 6/1903 | Sprague | 5/202 |
| 979,227 | 12/1910 | Tinkham | 5/202 |
| 1,645,885 | 10/1927 | Thompson | 403/100 |
| 1,765,455 | 6/1930 | Schultz . | |
| 3,899,110 | 8/1975 | Binding et al. | 403/102 X |
| 4,428,086 | 1/1984 | Harris . | |

*Primary Examiner*—Michael F. Trettel

*Attorney, Agent, or Firm*—Dressler, Goldsmith, Shore, Sutker & Milnamow, Ltd.

[57] ABSTRACT

Side rail members for supporting bed means in spaced relationship to a floor. The side rail members include first and second elongated side rail sections of generally L-shaped cross section disposed in substantially aligned end-to-end relationship. The side rail sections are interconnected by a knuckle member pivotally secured to the adjacent end portions thereof. The side rail sections are movable between a first in-use position wherein the side rail sections are disposed in an end-to-end relationsip and a second storage position wherein the first side rail sections are disposed in a side-by-side and generally parallel relationship, without the use of releasable extraneous fasteners or tools.

11 Claims, 3 Drawing Sheets

FOLDABLE SIDE RAIL MEMBER

FIELD OF THE INVENTION

This invention relates in general to side rail members for supporting bed means, and more particularly, to improved side rail members that are foldable between an in-use position and a storage position and a foldable spring structure incorporating such side rail members for use in a day bed.

BACKGROUND OF THE INVENTION

It is well known to support a box spring and mattress set above a floor by use of bed frames that include a pair of spaced-apart parallel side rail members that extend between a headboard and an endboard. The side rail members typically take the form of a unitary longitudinally extending angle iron member, of L-shaped cross section, having end plates associated with the respective ends. The end plates are secured to the respective headboard or endboard above the floor. Alternatively, the side rail members may be connected together by spaced-apart cross rail members and supported parted above the floor on leg members. The side rail members are approximately six feet in length to support standard size box spring and mattress sets.

A problem has long existed in the art in the handling, transporting, warehousing, and packaging of such side rail members due to their excessive length. It has heretofore been proposed to form such side rail members from two angle iron side rail sections that are secured together in an end to end relationship by use of a short angle iron connecting bracket. Examples of such side rail constructions are disclosed in U.S. Pat. Nos. 1,765,455 and 4,428,086. While both of these side rail constructions have solved some of the problems associated with unitary side rail members, both require the use of tools to manipulate releasable fasteners in order to transform the side rail member from its knocked-down storage position to its elongated in-use position.

Day beds have met with increasing commercial acceptance as providing a piece of furniture that can be readily converted into additional sleeping facilities. Such day bed constructions have traditionally included an upper spring structure, which supports a mattress assembly and sofa type back cushions. A lower unit is provided that is movable from a storage position beneath the upper spring structure to an in-use position alongside of the upper spring structure. The upper spring structure includes a pair of spaced-apart angle iron side rail members connected together by cross rail members. A spring assembly is suspended between the side rail members and the cross rail members.

For the same reasons discussed above with respect to bed frames, the shipping and storage of such spring structures has been a problem because of the bulky and lengthy frame members that comprise such structures.

Accordingly, it would be desirable to provide a side rail member or a spring structure for use in a day bed or the like, that is foldable to a collapsed, compact storage position, and yet which eliminates the need for releasable extraneous fasteners to retain the side rail member in an in-use position.

SUMMARY OF THE INVENTION

The foregoing disadvantages of the heretofore proposed side rail member designs are overcome by the present invention, wherein a knuckle member is pivotally connected at each of its ends by a permanent, non-releasable fastening member to adjacent side rail sections. The side rail sections are movable between a first in-use position, wherein the side rail sections are located in an end to end generally coplanar relationship and a second storage position, wherein the side rail sections are disposed in a side-by-side and generally parallel relationship with respect to one another and the knuckle member is disposed generally perpendicular to the side rail sections. The side rail sections are movable between their first and second positions without the necessity of releasing any fasteners and without the use of any tools.

The side rail member comprises first and second elongated side rail sections of generally L-shaped cross section and a generally L-shaped knuckle member. The side rail sections and the knuckle member have a vertical leg portion and a horizontal leg portion. The end portions of the vertical leg portion of the knuckle member are pivotally secured to an end portion of the vertical leg portion of the first and second side rail members by a non-releasable fastening member such as a rivet.

In accordance with a first preferred embodiment of the invention, the vertical leg portion of the knuckle member has a greater length than the length of the horizontal leg portion thereof so as to define extending end portions that extend beyond the edges of the horizontal leg portion. The extending end portions are respectively secured to the vertical leg portion of the first and second side rail sections by a rivet member that extends through openings formed therein. The knuckle member is positioned outside of the side rail members so that when the side rail sections are in their first in-use position the inner surface of the horizontal leg portion of the knuckle member is in supporting contact with the outer surfaces of the horizontal leg portions of the side rail sections.

In accordance with a second preferred embodiment of the invention, the knuckle member is positioned inside of the side rail members so that when the side rail sections are in their first in-use position the outer surface of the horizontal leg portion of the knuckle member is in supporting contact with the inner surfaces of the horizontal leg portions of the side rail sections. The end portions of the knuckle members are shaped and configured to facilitate movement.

In accordance with a third embodiment of the invention, a spring structure is provided that includes a pair of spaced-apart side rail members preferably constructed in accordance with the above discussed second embodiment. The side rail members are connected together by end rail members and a spring assembly is suspended therefrom. The simultaneous movement of the side rail members into their second storage is effective to fold the spring structure in half and thereby facilitate packaging, shipment, and storage of the spring structure.

DESCRIPTION OF THE INVENTION

Figure 1:
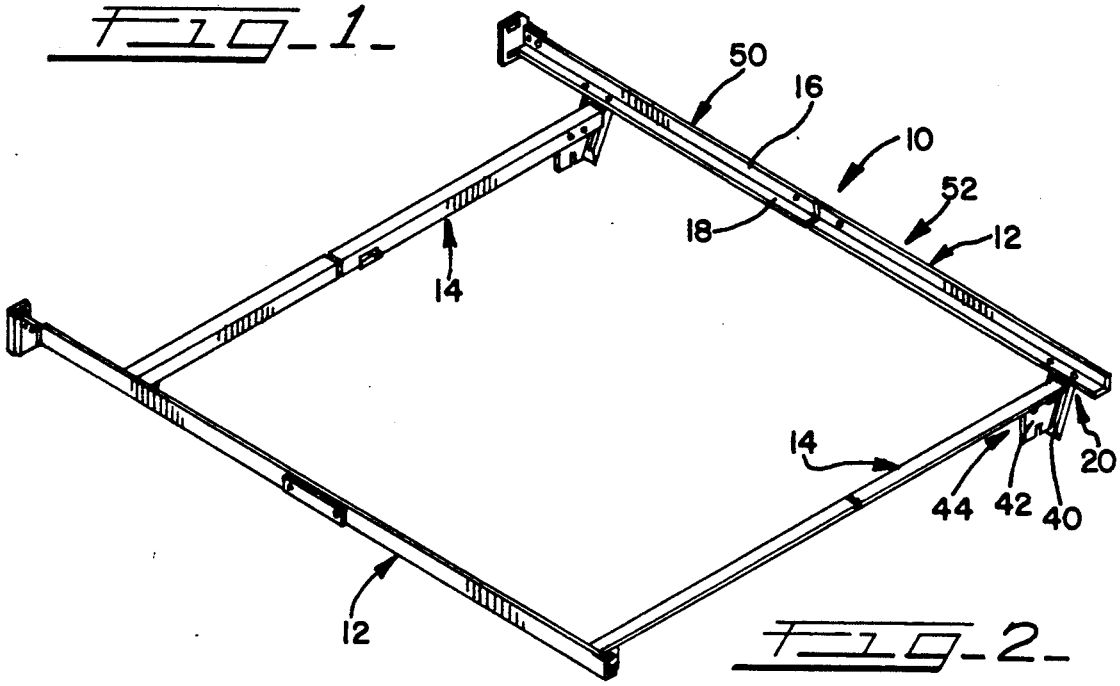
FIG. 1 is a perspective view of a bed frame construction incorporating side rail members constructed in accordance with a first preferred embodiment of the invention, with the side rail members in their in-use position.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiments illustrated.

Figure 2:
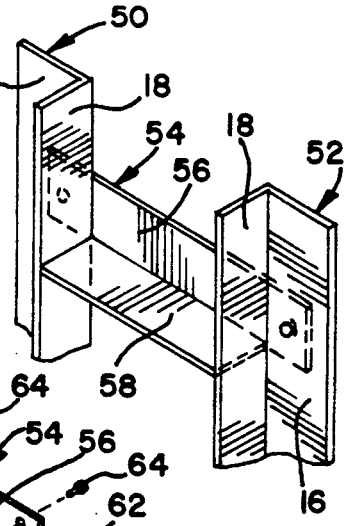
FIG. 2 is an enlarged perspective view of a portion of a side rail member shown in FIG. 1 in its storage position.
Figure 3:
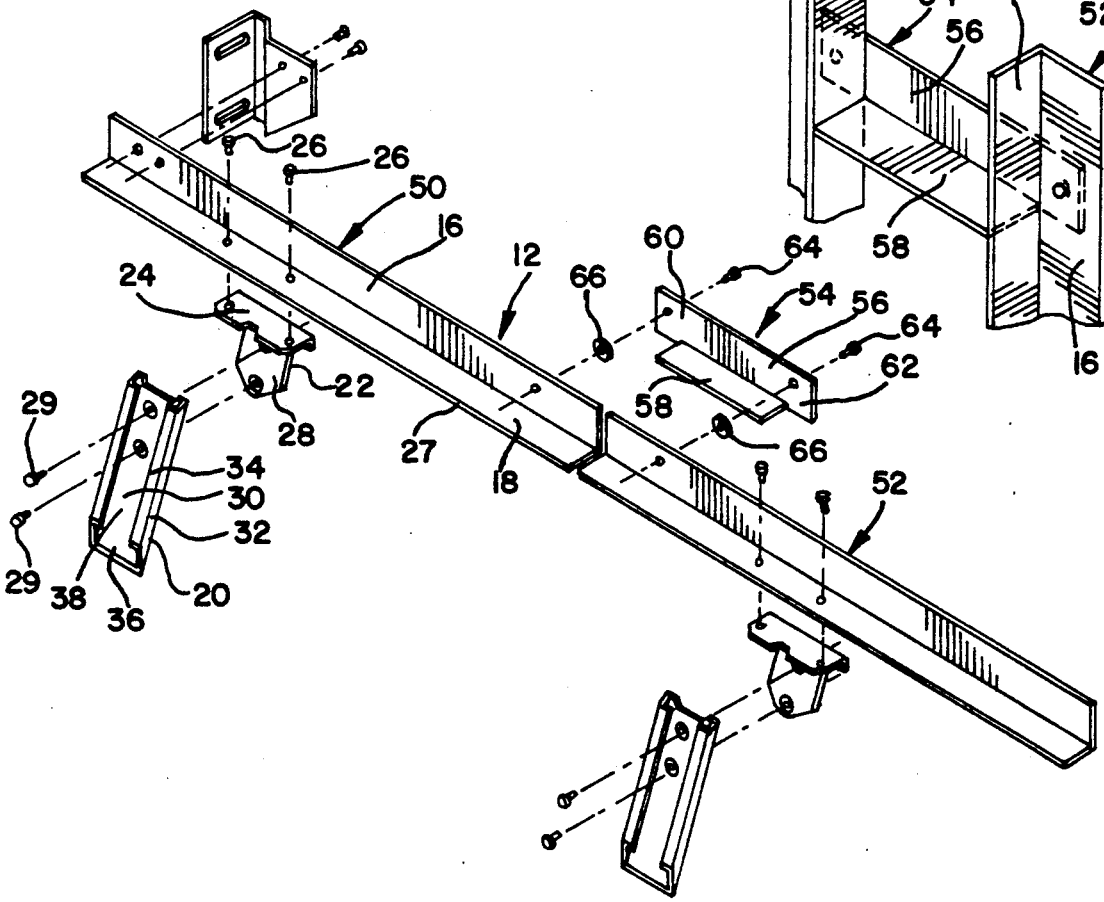
FIG. 3 is an exploded perspective view of a side rail member shown in FIG. 1.

Referring to FIGS. 1-3, a bed frame assembly 10 is shown which includes a pair of side rail members 12 constructed in accordance with a first preferred embodiment of the invention. Bed frame assembly 10 is generally of the type described in U.S. Pat. Re. No. 31,384, which patent is owned by the same assignee as the present invention and is herein incorporated by reference for a disclosure of specific details of the bed frame assembly.

Bed frame assembly 10 comprises a pair of side rail members 12 and a pair of cross rail members 14 arranged generally in a rectangular configuration. The construction of each of the side rail members 12 will be discussed in detail hereinbelow, but it is generally an angle iron having a vertical outboard flange or leg portion 16 and a horizontal flange or leg portion 18 which extends inwardly from leg portion 16. End plates 19 may be provided for attaching the bed frame assembly to a headboard in a well-known manner. A female socket member 20 is positioned adjacent to each end of each side rail and comprises a V-shaped attachment bracket 22 which has a horizontal flange portion 24 secured by rivets 26 to the bottom side surface 27 of the horizontal leg portion 18. Flange 24 joins at its outer edge with the upper end of an inwardly and downwardly sloped web 28 which is positioned at approximately 45° to the vertical. The web 28 extends beneath and is secured by rivets 29 to a similarly sloping bottom wall 30 of the female socket member 20.

The female socket member 20 comprises in addition to the bottom wall 30 a pair of vertical side walls 32. Inturned flanges 34 are formed at the upper edges of side wall 32. The socket member extends inwardly of the respective side rail and has an open lower end 36.

The socket member 20 defines a passageway 38 that receives a male or prong element generally designated 40 which is formed on the outboard edge of a pair of back-to-back disposed plates 42 of a caster wheel mounting bracket 44. Bracket 44 is provided at each end of each cross rail member 14 and the male member thereof extends into passageway 38 of socket member 20 so as to interlock the side rail members and the cross rail members. The cross rail members are preferably longitudinally adjustable in length to approximately the width of a spring frame.

In accordance with a first embodiment of the invention, each of the side rail members 12 comprises a first side rail section 50 and a second side rail section 52. Side rail sections 50 and 52 are formed from L-shaped angle iron so as to define vertical leg portions 16 and horizontal leg portions 18. Sections 50 and 52 are disposed in an aligned end to end relationship with respect to one another when in a first in-use position, as shown in FIG. 1.

Side rail sections 50 and 52 are secured together by an L-shaped angle iron knuckle or bracket member 54 having a vertical leg portion 56 and a horizontal leg portion 58. The vertical portion 56 is of greater length than the length of horizontal leg portion 58 so as to define extending end portions 60 and 62 that extend beyond the edges of horizontal leg portion 58. Knuckle member 54 is positioned alongside the adjacent end portions of the side rail sections such that the inner surface of the vertical leg portion 56 is in facing relationship with respect to the outer surface of the vertical leg portion 16 and the inner surface of the horizontal leg portion 58 is in facing relationship with respect to the outer surface of the horizontal leg portion 18.

The extending end portions 60 and 62 are pivotally secured to a corresponding vertical leg portion 16 by a non-releasable pivot means so as to permit the rail sections to pivot between a first in-use position, as shown in FIG. 1, and a second storage position, as shown in FIG. 2. The side rail sections 50 and 52, when in their first in-use position, are located in an end to end generally coplanar relationship with the inner surface of the horizontal leg portion 58 of the knuckle member 54 being in flush surface-to-surface supporting contact with the outer surface of the horizontal leg portions 18 of the side rail sections. The side rail sections 50 and 52 when in their second storage position are disposed in a side-by-side and generally parallel relationship with respect to one another and the knuckle member 54 is disposed generally perpendicular to the side rail sections, with the outer edges of horizontal leg position 58 being in contact with the outer surfaces of the leg portions 18 of the side rail sections.

Referring to FIG. 3, the non-releasable pivot means preferably comprises rivet members 64 that extend through openings formed in the extending end portions 60 and 62 and coaxially aligned openings formed in the vertical leg portions 16. A washer member 66 is received about each of the rivets 64 and is interposed between the vertical leg portion 56 and the vertical leg portion 16 so as to space these portions a short distance apart so as to serve as bushings to facilitate the pivotal movement of the side rail sections relative to the knuckle member.

Figure 4:
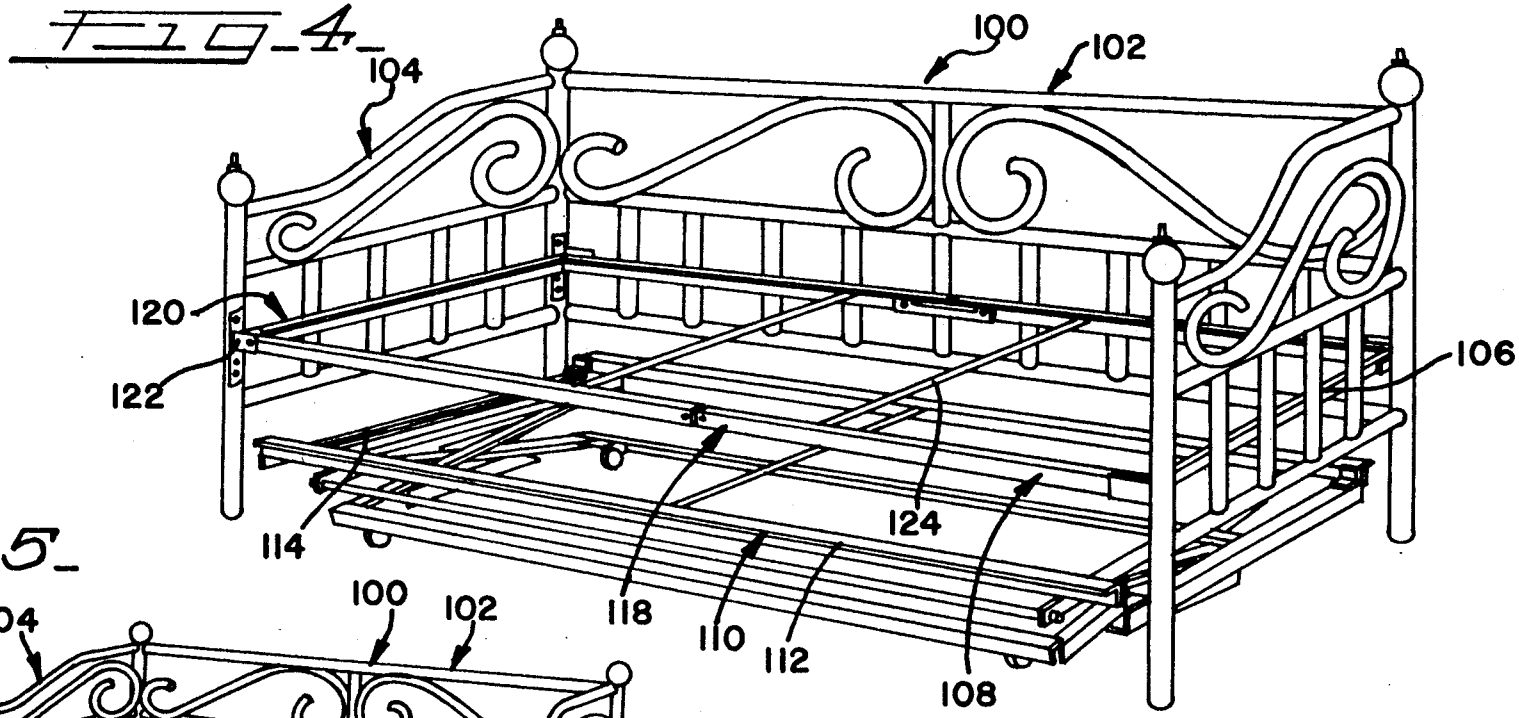
FIG. 4 is a perspective view of a day bed incorporating an upper spring construction in accordance with the present invention, with the lower unit in a retracted storage position.
Figure 5:
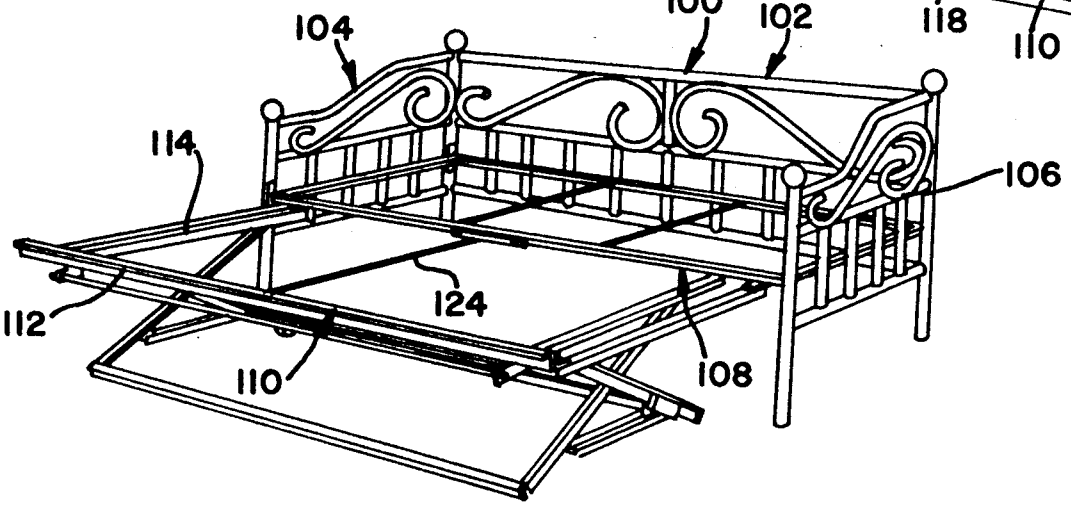
FIG. 5 is a view similar to FIG. 4, on a slightly reduced scale, with the lower unit in an extended in-use position.

Referring to FIGS. 4 and 5, a day bed 100 is shown that includes a foldable upper spring structure constructed in accordance with the principles of the present invention. Day bed 100 comprises a back assembly 102 and side assemblies 104 and 106, which, as is well-known in the art, may be formed of wood and/or metal, such as brass or the like. Day bed 100 is provided with an upper spring structure 108 for support of bedding thereon (not shown) and a bottom spring structure 110 for support of bedding thereon (not shown), which is movable between a retracted storage position below upper spring structure 108, as shown in FIG. 4, and an extended in-use position disposed alongside of upper spring structure 108, as shown in FIG. 5.

Bottom spring structure 110 includes a spring structure having a pair of spaced, parallel side rail members 112 and a pair of spaced, parallel cross rail members 114 connected together and arranged generally in a rectangular configuration. Bottom spring structure 110 is supported by a support structure 116 of a well known construction, which is movable from a collapsed storage position, as shown in FIG. 4, to an extended and latched support position, as shown in FIG. 5. Upper spring structure 108 includes a spring structure having a pair of spaced, parallel side rail members 118 and a pair of spaced, parallel cross rail members 120 arranged generally in a rectangular configuration. The specific construction of the upper spring structure will be discussed in detail hereinbelow. Upper spring structure 108 is secured to upright posts associated with assemblies 102, 104 and 106 by brackets 122 in a well-known manner. The upper spring structure 108 and bottom spring structure 110 are provided with one or more stretcher bars 124 to support a wire spring assembly 126 which, as is well-known in the art, is connected by helical springs at the margins thereof to the frame members of the upper and bottom spring structures, as shown in FIG. 6.

Figure 6:
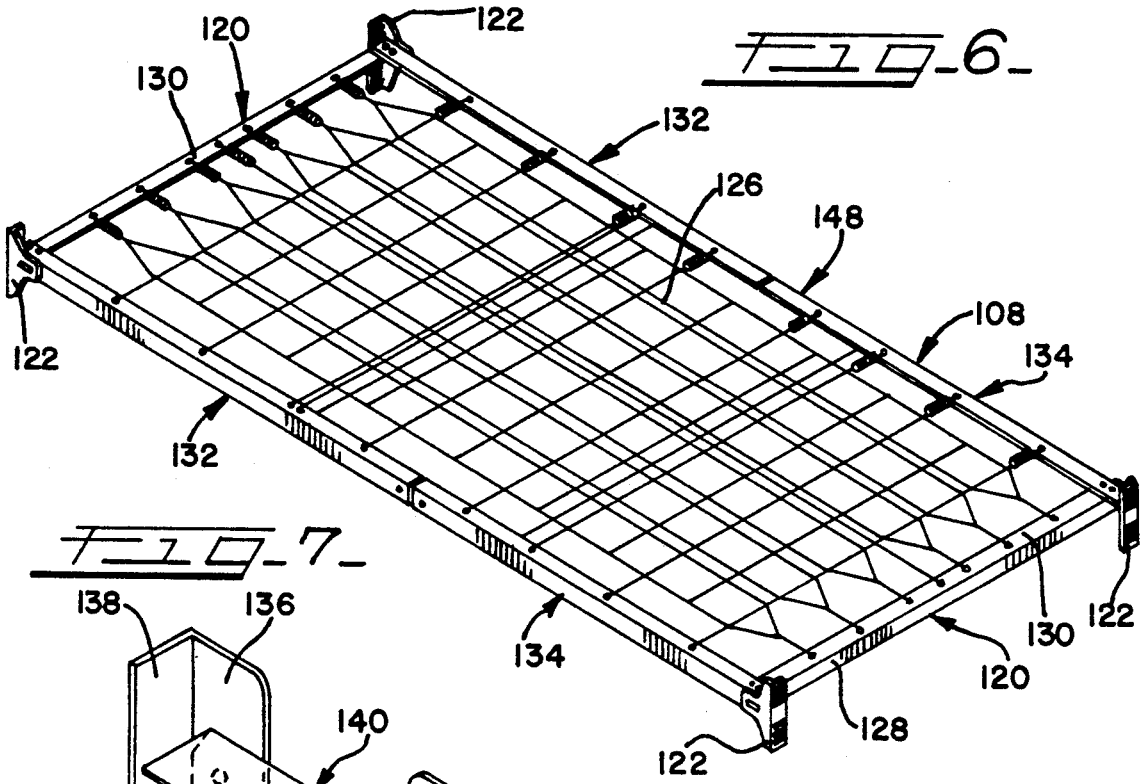
FIG. 6 is a perspective view of a spring construction in its in-use position, incorporating side rail members constructed in accordance with a second preferred embodiment of the invention.
Figure 7:
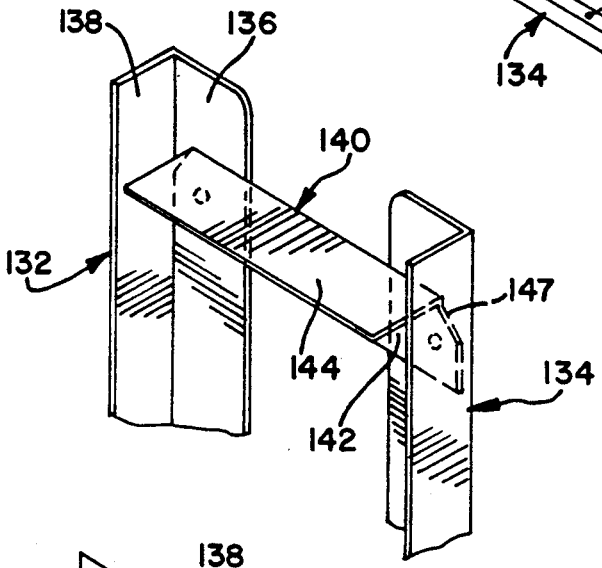
FIG. 7 is an enlarged perspective view of a portion of a side rail member shown in FIG. 6 in its storage position.
Figure 8:
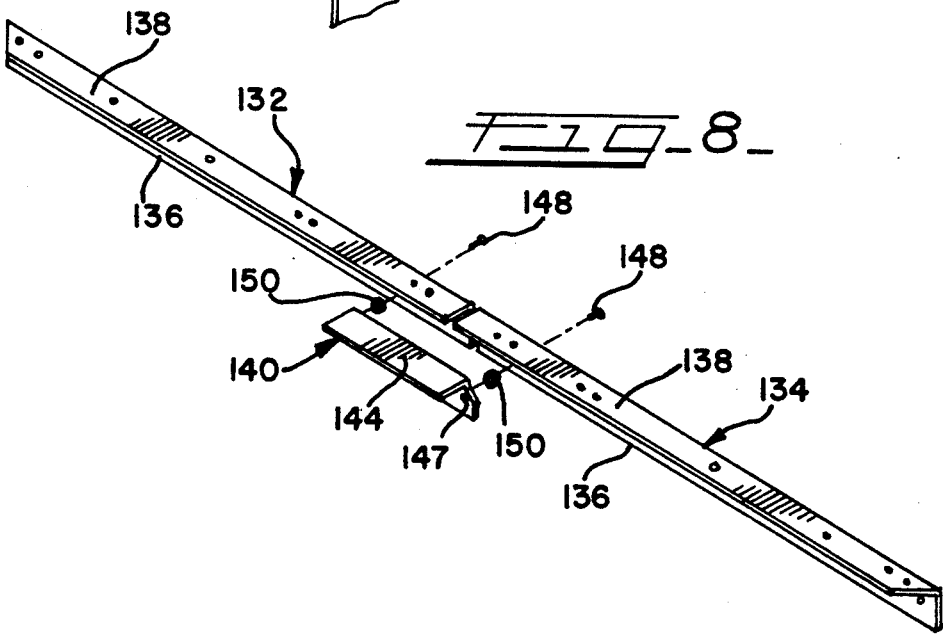
FIG. 8 is an exploded perspective view of a side rail member shown in FIG. 6.

Referring to FIGS. 6–8, a preferred embodiment of the upper spring structure 108 is shown comprising a pair of spaced side rail members 118 and a pair of spaced cross rail members 120 that are connected together at their respective ends to form a rectangular configuration. Cross rail members 120 are preferably formed from a unitary angle iron member having a vertical outboard flange or leg portion 128 and a horizontal flange or leg portion 130 which extends inwardly from the upper edge of leg portion 128.

In accordance with a second embodiment of the invention, each of the side rail members 118 comprises a first side rail section 132 and a second side rail section 134. Side rail sections 132 and 134 are formed from L-shaped angle iron members so as to define a vertical flange or leg portion 136 and a horizontal flange or leg portion 138 which extends inwardly from the upper edge of leg portion 136. Sections 1 32 and 134 are disposed in an aligned end to end relationship with respect to one another when in a first in-use position, as shown in FIG. 6.

Side rail sections 132 and 134 are secured together by an L-shaped angle iron knuckle or bracket member 140 having a vertical flange or leg portion 142 and a horizontal flange or leg portion 144. The vertical leg portion 142 is of greater length than the length of horizontal leg portion 140 so as to define extending end portions 146 that extend beyond the edges of the horizontal leg portion. The upper corners of end portions 146 are removed to form a straight line, as shown at 147, to facilitate movement of the side rail sections between their in use and storage positions. Knuckle member 140 is positioned alongside the adjacent end portions of the side rail sections 132 and 134 such that the outer surface of the horizontal leg portion 144 of the knuckle member 140 is in facing relationship with the inner surfaces of the horizontal leg portions 138 of the side rail sections and the outer surface of the vertical leg portion 142 of the knuckle member 140 is in facing relationship with the inner surface of the vertical leg portions 136 of the side rail sections.

The respective extending end portions 146 are pivotally secured to a corresponding vertical leg portion 136 by a non-releasable pivot means so as to permit the rail sections to pivot between a first in-use position, as shown in FIG. 6, and a second storage position, as shown in FIG. 7. The rail sections 132 and 134 when in their first in-use position are located in an end to end generally coplanar relationship wherein the outer surface of the horizontal leg portion 144 of the knuckle member 140 is in flush surface-to-surface supporting contact with the inner surfaces of the horizontal leg portion 138 of the side rail sections and the outer surface of the vertical leg portion 142 of the knuckle member is in facing relationship to the inner surface of the vertical leg portions 136 of the side rail sections. The side rail sections 132 and 134 when in their second storage position are disposed in a side-by-side and generally parallel relationship with respect to one another and the knuckle member 140 is disposed generally perpendicular to the side rail sections with the outer edges of the vertical leg portion 142 being in contact with the inner surfaces of the leg portions 138 of the side rail sections.

Referring to FIG. 8, the non-releasable pivot means preferably comprises a rivet member 148 that extends through coaxially aligned openings formed in the vertical leg portions 136 and the extending end portions 146. A washer member 150 is received about each rivet 148 and is interposed between vertical leg portion 136 and vertical leg portion 142 so as to space these portions a short distance apart and serve as bushings so as to facilitate the pivotal movement of the side rail sections relative to the knuckle member.

Referring to FIGS. 3 and 8, it will be seen that the knuckle member retains the side rail sections in an end-to-end relationship, but spaced by a small gap. This gap provides clearance to readily permit the side rail sections to be folded between their in-use positions and their storage positions.

From the above, it should be clear that novel side rail constructions are provided wherein the side rail sections may be folded to a compact position after manufacture, and thereafter inserted into a compact container for storage and shipment. When the side rail constructions are ready to be used, the side rail sections need only to be folded into end-to-end relationship without the necessity to provide or use extraneous fasteners. In addition to the advantages of compact storage and ease of assembly, the side rail constructions of the present invention provides a stable, high-strength connection between the side rail sections.

It should be understood that while specific embodiments have been illustrated and described, the present invention is not limited thereto, and is intended to cover such modifications as may come within the spirit and scope of the appended claims.

What is claimed is:

1. A side rail member for supporting bed means or the like in spaced relationship to a floor, comprising: first and second elongated side rail sections of generally L-shaped cross section disposed in substantially aligned end to end relationship with respect to one another, said side rail sections having vertical leg portions and horizontal leg portions; and a generally L-shaped knuckle member having a vertical leg portion and a horizontal leg portion, said knuckle member being positioned adjacent the end portions of said side rail sections, said vertical leg portion of said knuckle member having a greater length than the length of said horizontal leg portion of said knuckle member so as to define extending end portions that extend beyond the edges of said horizontal leg portion, said extending end portions being secured to a vertical leg portion of a corresponding first and second side rail section by non-releasable pivot means so as to permit said rail sections to pivot between a first in-use position wherein said side rail sections are located in an end to end generally coplanar relationship with the inner surface of said horizontal leg portion of said knuckle member being in surface-to-surface supporting contact with the outer surfaces of said horizontal leg portions of said side rail sections and a second storage position wherein said side rail sections are disposed in a side-by-side and generally parallel relationship with respect to one another and said knuckle member is disposed generally perpendicular to said side rail sections.

2. The side rail member as defined in claim 1 wherein said pivot means is a rivet member extending through corresponding openings formed in said extending end portion of said knuckle member and said vertical leg portion of said side rail section.

3. The side rail member as defined in claim 2 wherein a spacing washer member is received about said rivet members and is positioned between said extending end portion of said knuckle member and said vertical leg portion of said side rail section.

4. The side rail member as defined in claim 1 wherein said knuckle member is positioned outside of said side rail sections.

5. The side rail member as defined in claim 1 wherein the edges of said side rail sections are spaced a short distance apart when in their first position.

6. A side rail member for supporting bed means or the like in spaced relationship to a floor, comprising: a first and second elongated side rail sections of generally L-shaped cross section disposed in substantially aligned end to end relationship with respect to one another, said side rail sections having vertical leg portions and horizontal leg portions, and a generally L-shaped knuckle member having a vertical leg portion and a horizontal leg portion, said knuckle member being positioned inside of said side rail sections and adjacent the end portions thereof, said vertical leg portion of said knuckle member having a greater length than the length of said horizontal leg portion of said knuckle member so as to define extending end portions that extend beyond the edges of said horizontal leg portion, said extending end portions being secured to a vertical leg portion to a corresponding first and second side rail section by non-releasable pivot means so as to permit said side rail sections to pivot between a first in-use position wherein said side rail sections are located in closely longitudinally spaced end to end generally coplanar relationship with the outer surface of said horizontal leg portion of said side knuckle being in surface-to-surface supporting contact with the inner surfaces of said horizontal leg portions of said rail sections, and a second storage position wherein said side rail sections are disposed in a side-by-side and generally parallel relationship with respect to one another and said knuckle member is disposed generally perpendicular to said side rail sections, the corners of said vertical portion of said knuckle member that are adjacent said horizontal portion of said knuckle member being cut-away along a straight line to permit said first and second side member sections to pivot between their first and second positions without interference with one another.

7. The side rail member as defined in claim 6 wherein said pivot means is a rivet member extending through corresponding openings formed in said extending end portion of said knuckle member and said vertical leg portion of said side rail member.

8. The side rail member as defined in claim 7 wherein a spacing washer member is received about said rivet members and is positioned between said extending end portion of said knuckle member and said vertical leg portion of said side rail section.

9. A spring structure for supporting bed means in spaced relationship to a floor, comprising: a pair of spaced parallel side rail members and a pair of spaced parallel cross rail members, said side rail members and cross rail members being interconnected at their respective ends to form a generally rectangular configuration, a wire spring assembly being connected at the margins thereof to said side rail members and said cross rail members, each of said side rail members having first and second elongated side rail sections of generally L-shaped cross section disposed in substantially aligned end to end relationship with respect to one another, said side rail sections having vertical leg portions and horizontal leg portions, and a generally L-shaped knuckle member having a vertical leg portion and a horizontal leg portion, said knuckle member being positioned inside of said side rail sections and adjacent the end portions thereof, said vertical leg portion of said knuckle member having a greater length than the length of said horizontal leg portion of said knuckle member so as to define extending end portions that extend beyond the edges of said horizontal leg portion, said extending end portions being secured to a vertical leg portion of a corresponding first and second side rail section by non-releasable pivot means so as to permit said side rail sections to pivot between a first in-use position wherein said side rail sections are located in closely longitudinally spaced end to end generally coplanar relationship with the outer surface of said horizontal leg portion of said side knuckle member being in surface-to-surface supporting contact with the inner surfaces of said horizontal leg portions of said rail sections, and a second storage position wherein said side rail sections are disposed in side-by-side and generally parallel relationship with respect to one another and said knuckle member is disposed generally perpendicular to said side rail sections, the corners of said vertical portion of said knuckle member that are adjacent said horizontal portion of said knuckle member being cut-away along a straight line to permit said first and second side member sections to pivot between their first and second positions without interference with one another.

10. The spring structure as defined in claim 9 wherein said pivot means is a rivet member extending through corresponding openings formed in said extending end portion of said knuckle member and said vertical leg portion of said side rail member.

11. The spring structure as defined in claim 10 wherein a spacing washer member is received about said rivet members and is positioned between said extending end portion of said knuckle member and said vertical leg portion of said side rail section.

* * * * *